United States Patent [19]

Nelson

[11] 4,091,996

[45] May 30, 1978

[54] SPRINKLER IRRIGATION SYSTEM AND APPARATUS FOR DIRECTING A STREAM OF WATER INTO THE ATMOSPHERE

[75] Inventor: Barton R. Nelson, Walla Walla, Wash.

[73] Assignee: Nelson Irrigation Corporation, Walla Walla, Wash.

[21] Appl. No.: 704,676

[22] Filed: Jul. 12, 1976

[51] Int. Cl.[2] ..... B05B 1/32

[52] U.S. Cl. ..... 239/177; 138/45; 239/230; 239/533.14

[58] Field of Search ..... 239/11, 177, 212, 230, 239/533.13, 533.14; 138/45, 46

[56] References Cited

U.S. PATENT DOCUMENTS

| | | | |
|---|---|---|---|
| 590,892 | 9/1897 | Knight | 138/45 |
| 2,188,354 | 1/1940 | Hudson | 239/533.14 |
| 2,454,929 | 11/1948 | Kempton | 138/45 |
| 2,500,750 | 3/1950 | Halenza | 138/45 X |
| 2,781,058 | 2/1957 | Warhus | 138/45 |
| 3,680,778 | 8/1972 | Sisson et al. | 239/177 X |
| 3,779,462 | 12/1973 | Bruninga | 239/230 |
| 3,837,363 | 9/1974 | Meronek | 239/533.13 X |
| 3,980,104 | 9/1976 | Kabai | 239/533.13 |

FOREIGN PATENT DOCUMENTS

| | | | |
|---|---|---|---|
| 344,632 | 3/1960 | Switzerland | 239/533.13 |

*Primary Examiner*—Robert R. Song
*Assistant Examiner*—Michael Mar
*Attorney, Agent, or Firm*—Cushman, Darby & Cushman

[57] ABSTRACT

A method of directing a source of water under pressure, which may vary within a wide range of pressures above a predetermined minimum pressure, at a substantially constant rate of flow into the atmosphere for purposes of sprinkler irrigation which comprises the steps of communicating the source of water under pressure with an inlet of a sprinkler body having an outlet in flow communicating relation with the inlet, providing an annular member of resilient material within the outlet having a discharge orifice defining opening therethrough, and allowing the water under pressure flowing through the inlet in communication with the resilient annular member to deform the resilient annular member an amount proportional to the amount such water pressure is in excess of the predetermined minimum pressure and by such deformation to reduce the size of the opening an amount proportional to the deformation to thereby cause the water flowing through the opening to be defined as a stream entering the atmosphere with a cross-sectional size and velocity which vary inversely with respect to each other such that a substantially constant amount of water per unit time is contained in the stream entering the atmosphere throughout the range of pressure variation in the source and a sprinkler head and sprinkler irrigation system embodying such method.

13 Claims, 8 Drawing Figures

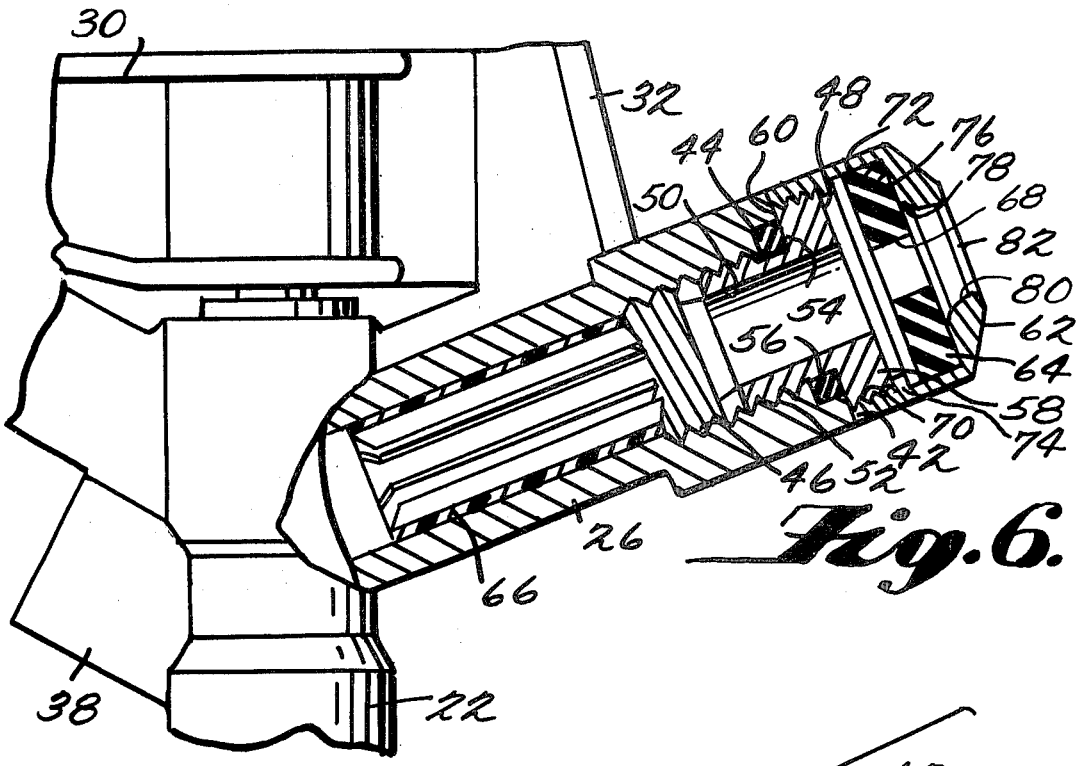
Fig. 6.
Fig. 8.
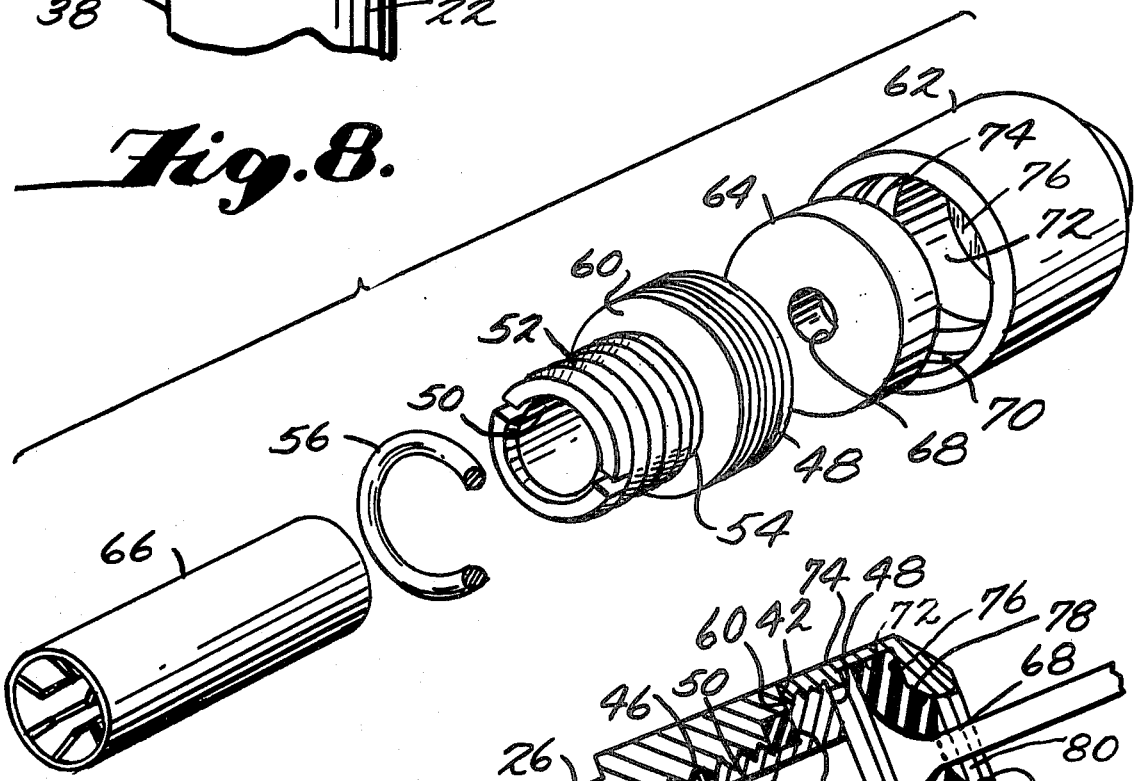
Fig. 7.
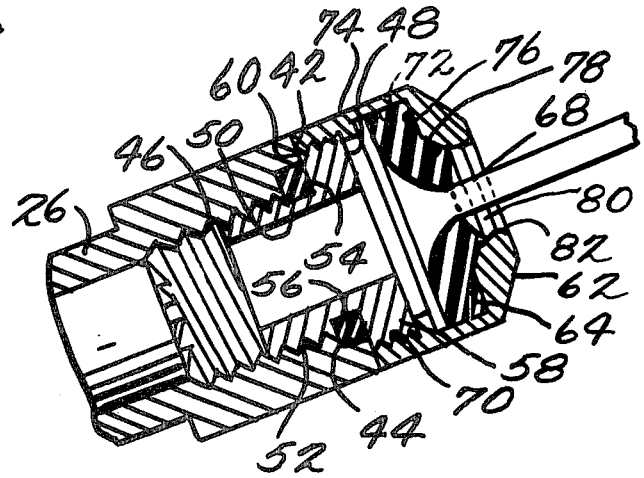

SPRINKLER IRRIGATION SYSTEM AND APPARATUS FOR DIRECTING A STREAM OF WATER INTO THE ATMOSPHERE

This invention relates to sprinkler irrigation and more particularly to improvements in sprinkler heads and sprinkler irrigation systems embodying the same which render the systems capable of more efficiently accommodating vertical undulations in the surface of the field to which the water is applied or other causes of pressure variation.

The benefits and advantages of sprinkler irrigation are well known. This practice has enjoyed widespread use for a period of many years and continues to increase. Many different types of systems have been developed, such as permanent set systems, solid set systems, hand move systems, side roll wheel move systems, towline systems, traveling sprinkler systems, moving lateral systems and center pivot systems. Each of these various types of systems has various different advantages and disadvantages which makes it particularly suitable for use where particular field conditions are presented. One field condition which presents difficulties in the operation of all types of systems is the field surface undulations or change in vertical level of the surface of the field within the area where the system is installed. The severity of the difficulties presented is to some extent dependent upon the type of system utilized. A permanent set system which involves the permanent mounting of a feeder pipe network within the ground well below the field surface and the permanent installation of a series of riser pipe-sprinkler head assemblies extending upwardly therefrom above the surface presents a situation where any given sprinkler head within the system will always be disposed at the same operating height. Consequently, any difference in the constant operating height as between the various sprinkler heads can be accommodated in the initial installation by the selection of the sprinkler nozzle size and the like. This initial one-time alleviation of the difficulties presented is not possible in all of the other systems, however, since the operating heights of the individual sprinkler heads of the systems are subject to change after initial installation.

In systems such as the center pivot system, the moving lateral system, and the traveling sprinkler system, the sprinkler head or heads of the system are moved during operation so that their operating height will vary as the vertical surface level of the field over which they are operative varies. In solid set systems, hand move systems, side roll wheel move systems and towline systems, the sprinkler heads do not move while in operation but movement to different locations within the field at various times between operating periods usually takes place. The frequency of such movements varies depending on the particular system, but even with solid set systems of the type which are moved only once or a few times during a season into and out of the same field area, there exists the likelihood that different sprinkler heads of the system will be successively installed in different locations in the field unless precautions are taken to clearly designate where the specific field location of each section of the system should be reinstalled before or during disassembly. In general, it can be stated that the difficulties presented by surface undulations are most severe in center pivot systems because the individual sprinkler heads are moved during operation and because these systems are of such large covering capacity (usually 125 acres and above) that the likelihood of encountering surface undulation is greatly increased. Consequently, the improvements of the present invention will be described in connection with a center pivot system where the severity of the height change problem is the greatest and, hence, the advantages of the improvements of the present invention are the greatest. It will be understood that there are many other causes of pressure variation in sprinkler irrigation systems and hence the principles of the present invention are applicable to all systems with the advantages accruing being generally proportional to the severity of the pressure change difficulties presented.

A center pivot system embodies a central field source of water which usually is contained in a vertical pipe, the water source being energized through a suitable powered pump, such as an engine-pump assembly, to provide the required pressure and flow input (in terms of psi and gpm) to accomplish the desired output. The system further includes a main feed line assembly extending radially from the source pipe and supported for horizontal pivotal movement about the source pipe and for limited longitudinal articulated movement by a series of longitudinally spaced wheeled towers. Various arrangements are provided for driving the wheeled towers at different speeds to coordinatingly accommodate the different horizontal components of movement traversed by each wheeled tower. The system further embodies a series of longitudinally spaced sprinkler heads along the main feed line. The sprinkler heads utilized are usually of the impact drive type, although sprinkler heads either of the spray type or of a movable type operating on modes other than impact drives may also be used. Invariably, the sprinkler heads have one or more discharge orifices of fixed dimensions, the particular orifice size chosen being dependent upon the particular output requirements determined by the radial position of the particular sprinkler head along the feed line in relation to the source pipe, taking into account the desired overlapping of the output patterns of adjacent sprinkler heads.

If it is assumed that a center pivot system is to be installed in a perfectly level field, it can be expected that the operating height of each sprinkler head in the system will remain constant and, hence, initial design considerations in the choice of input pressure and flow and individual sprinkler head output is a fairly routine matter and a fairly consistently efficient operation can be expected unless there are other reasons for fluctuations of the system pressure.

With the above in mind, consideration of the changes which occur in the system where the surface of the field undulates rather than being perfectly level reveals that the detrimental effects increase considerably beyond a straight line relationship to the increase in the height changes encountered. The reason for this snowballing effect is that while the immediate effect of a change in operating height of any one sprinkler head is to change the inlet pressure of the water entering that sprinkler head due to the change in potential head, this change in pressure has further reactive effects within the system as well as reactive effects with respect to the output of the system. These interdependent effects can best be understood by considering a height change in one sprinkler head of the system, as for example a sprinkler head at or near the outer end of the feed line.

First, it can be assumed that the rate of potential head change in the inlet water per unit change in operating height is roughly 0.433 psi per foot. Thus, a 10-foot change results in a change of 4.33 psi and a 100-foot change results in a change of 43.3 psi. When it is considered that a usual center pivot system will traverse a circular ground area of a radius of about a quarter of a mile or more and apply water to 125 acres and more, it can be readily understood that there is a fair percentage of fields where vertical level variations are within the 10 foot to 100 foot range and a percentage which extend beyond into the 100 foot to 200 foot range and above.

Reverting to the illustrative example of the single sprinkler head at the outer end of the feed line and assuming a change in vertical level of 10 feet as exemplary, it will be evident from the above that the inlet pressure to the sprinkler head will change 4.33 psi. Whether this change is up or down will, of course, depend upon whether the vertical level change is above the perfectly level field condition originally contemplated or below the same. When above, this means that the sprinkler head is over a hill in the field and the inlet pressure will decrease. When below, this means that the sprinkler head is over a depression in the field and the inlet pressure will increase. Since the sprinkler head is of fixed outlet orifice size, a decrease in inlet pressure means a decrease in output flow or gpm and an increase in inlet pressure means an increase in output gpm.

The interdependent effect of this system change to the output of the sprinkler head is to apply less water to the hills and more water to field depressions, a situation which is exactly the reverse from that desired. That is, more water is delivered to the area in the field where water is most likely to accumulate and less is delivered to the area where water is most likely to run off before being absorbed. The interdependent effect of this change within the system is similarly retrogressive. The increase or decrease in psi and gpm within the feed line at the sprinkler head location will be reflected back through the feed line to the source. The changes within the feed line, in turn, comparably effect changes in the output of all the sprinkler heads of the system. Moreover, since the engine-pump assembly at the source does not utilize a positive displacement pump, changes will take place in the operating characteristics of the pump and engine which will likewise effect the whole system. Consequently, there is a feedback of changes which effects further changes. Thus, all of the changes taking place within the system are of such a complex nature as to make a simple indication of the effects difficult to state with accuracy. In general, it may be indicated that the prime mover (whether internal combustion or electric motor) will tend to increase its power consumption to maintain a constant pump speed when the sprinkler head is lowered. Conversely, when the sprinkler head is raised, there will be a tendency for the gpm input of the prime mover-pump assembly to fall off.

With the above in mind, a basic systems design consideration is just how much variation, due to the height change expected to be encountered, can be tolerated? Since the most immediate and greatest effect of height change at any given sprinkler head is a change in the input pressure to that sprinkler head, this effect could be expected to provide the toleration limit. Since the inlet and outlet passage sizes for any given sprinkler head chosen are fixed, changes in inlet pressure will result in changes in gpm and changes in output pattern. Thus, as inlet pressure increases, the pattern radius increases and gpm increases. Of these two changes, the most significant is the change in gpm. The effect of radius change in the pattern is relatively slight because of the overlapping patterns of adjacent sprinkler heads. Since the desired effect of the system is to distribute a given gpm to the area covered, an intolerable increase or decrease in gpm will be encountered before an intolerable pattern change becomes evident. The system variation tolerance for any sprinkler head can therefore be expressed in terms of a percentage deviation from the designed gpm thereof.

With the above in mind, it can be seen that a system designed to operate under substantially constant pressure in a substantially constant level field can not be expected to operate in undulating fields without reaching a point where the height level change in the field will cause a gpm variation which is beyond a reasonable tolerance range. If a 10% variation is chosen as a reasonable tolerance range, then it becomes possible to determine the field level variation for a given system which will produce in excess of a 10% variation in gpm. Thus, if the designed system is established to cover an area of approximately 125.6 acres, with a system capacity of 1000 gpm and pivot point pressure of 60 psi, an exemplary sprinkler head in the system can be chosen in order to determine what level change of that sprinkler head will result in a 10% variation in its designed gpm. If a sprinkler head 684.4 feet from the pivot point along the total 1320 foot length of the system is used as illustrative, it is noted that the particular sprinkler head is designed to operate at approximately 50 psi inlet pressure (10 psi pressure loss from the pivot point source pressure) with a fixed outlet nozzle of 9/64 inch to deliver a designed gpm of 4.07 gpm. By consulting the performance chart relating to the sprinkler head, it is a simple matter to find the inlet pressure required to increase the gpm 10% (4.07 times 0.10 = 4.47 gpm approx.) or to 4.47 gpm. The pressure required is 60 psi indicating that anything over a 10 psi increase will exceed the 10% gpm tolerance. This 10 psi differential converts into a height level differential of approximately 23 feet (10 psi divided by 0.433 = 23 feet approx.).

From the above, it can be concluded that in order to make presently designed systems operable within reasonable gpm tolerances in fields having height level variations which exceed approximately 23 feet, it is necessary to somehow accommodate the variations of pressure within the system caused by the height variation. One way in which large height level differentials can be accommodated is to provide flow control valves in the inlet side of sprinkler heads in the system subject to such large height differentials. Flow control valves of the type indicated have been commercially available for many years and have been utilized in a wide variety of different water pressure systems. A well-known valve of this type is commercialized under the name Dole by Eaton Corporation. Page 2 of a brochure relating to the Dole flow control valve, bearing a 1963 copyright notice, includes the following description:

"The Dole Flow Control is a simple selfcleaning device designed to deliver a constant volume of water from a plumbing fixture outlet whether the pressure is 15 psi or as high as 125 psi. The controlling mechanism consists of a flexible orifice that varies its area inversely with the pressure so that a constant flow rate is maintained.

The Dole Flow Control is a device to produce pressure drop. Until the inlet pressure reaches the threshold pressure, generally 12 to 15 psi, the flexible insert remains as a fixed orifice. After the threshold pressure is reached, the pressure drop will be whatever is necessary to absorb the energy not required to overcome the system resistance and to sustain a rated flow. Flow rates are accurate within plus or minus 10% of the nominal flow rate. Considering individual flow controls, the rate will stay within 5 to 8% of the mean flow rate through the full range. Good accuracy is maintained to about 125 psi. The above figures represent pressure drop across the valve." The subject matter of the Dole flow control assembly is disclosed in several U.S. Pat. Nos. among which are the following: 2,389,134; 2,454,929; 2,732,859; 2,775,984; and 3,444,897. These patents disclose both the exact commercial configuration as well as exemplary modifications thereof which disclosures are hereby incorporated by reference into the present specification for background purposes.

The known advantages of inlet mounted flow control assemblies in sprinkler systems are not obtained without commensurate known disadvantages. The primary disadvantage resides in the fact that all of the advantages are achieved, as set forth in the above quotation, by introducing into the system a pressure drop which will be whatever is necessary to absorb the energy not required to overcome the system resistance and to sustain a rated flow. Thus, viewed in terms of the entire system including the energy input in the form of the engine-pump assembly, the energy input requirements must be sufficiently great to enable the flow control assemblies to properly provide their energy absorbing function. Stated differently, since known flow control assemblies function on an energy absorbing or energy dissipating basis within the system, such energy dissipation must be taken into consideration in determining the energy input requirements.

When this information is applied to the illustrative example previously noted, the inlet pressure requirements must be increased by 15 psi in order to insure operability of the flow control valves and achieve the designed gpm output. The formulation for determining the horsepower requirements of the prime mover is:

$$hp = \text{Head in feet} \times gpm/3960 \times \text{pump efficiency}$$

(where Head in feet in obtained by multiplying the input psi by a factor equal to 2.31). Assuming a pump efficiency of 75%, the horsepower requirements for the original system are:

$$hp = 60 \times 2.31 \times 1000/3960 \times 0.75 = 46.67.$$

By increasing the psi input pressure 15 psi to 75 psi, the horsepower requirements now become:

$$hp = 75 \times 2.31 \times 1000/3960 \times 0.75 = 58.33.$$

It will be appreciated that operating costs increase linearly with horsepower (11.67 hp). Of greater significance, however, is that original equipment costs increase at a rate considerably in excess of a straight line relationship. This is, as the horsepower increases, the cost of incremental increases in horsepower can be expected to increase.

An object of the present invention is to provide an improved method of using flow control assemblies of the type described and improved apparatus for carrying out such method of systems of the type mentioned above which will eliminate or substantially alleviate the known disadvantages of the use of such flow control assemblies while at the same time retaining all or substantially all of the known advantages thereof. In accordance with the principles of the present invention, this objective is obtained by causing the water flowing through the inlet of a sprinkler head in the system to communicate with the resilient flow control member to thereby effect the deformation thereof and to allow the deformation of the flow control orifice of the flow control member to define the stream of water entering the atmosphere so that a constant water flow rate is maintained through variation of the crosssectional size of the stream entering the atmosphere in an inverse proportional relationship to variation in the velocity of the water stream entering the atmosphere throughout the range of variation of the water pressure flow through the inlet. By following these procedures in accordance with the principles of the present invention, a constant flow rate of the water stream entering the atmosphere is obtained without the necessity of absorbing energy within the system upstream from the position of water stream definition or formation. Consequently, by utilizing the principles of the present invention, the need to provide sufficient input energy in the system to offset the energy absorption within the system necessary heretofore to obtain constant rate output is virtually eliminated and yet constant rate output is maintained.

An important advantage of the present invention is that the principles of the present invention can be carried out by apparatus which does not embody complex and expensive construction and assembly. In accordance with the constructional principles of the present invention, the apparatus embodies a new combination of known components which can be constructed and assembled in accordance with known techniques to obtain all of the advantages mentioned above. Viewed in terms of the modifications of known apparatus required in accordance with the principles of the present invention, the flow control assembly sometimes mounted in the inlet of the sprinkler head is removed therefrom and utilized to replace the outlet nozzle assembly in the outlet of the sprinkler head. Thus, the cost of construction and assembly of the apparatus of the present invention is at least comparable if not less than the cost of known apparatus.

The significance of the present invention resides in the system energy input savings that can be obtained by utilizing the principles of the present invention in the output procedures of the system, that is, in defining or formulating the water stream or streams of the system entering the atmosphere. Thus, while the principles of the present invention relate to the output procedures and apparatus, the advantages accruing as a result of practicing the principles of the present invention are not so much reflected in the results of the output obtained as they are in the required input. Consequently, an important aspect of the present invention resides in recognizing that significant energy input advantages can be obtained by utilizing the improved output procedures and apparatus embodying the principles of the present invention.

These and other objects of the present invention will become more apparent during the course of the following detailed description and appended claims.

The invention may best be understood with reference to the accompanying drawings, wherein an illustrative embodiment is shown.

In the drawings

FIG. 6 is a fragmentary side elevational view partly in section of the sprinkler head shown in FIG. 4 showing the position of the stream defining orifice of the flow control member when the sprinkler head is inoperable;

FIG. 7 is a fragmentary sectional view of the structure shown in section in FIG. 6 illustrating a position of the stream defining orifice of the flow control member when the sprinkler head is operable; and FIG. 8 is an exploded perspective view of the stream defining flow control nozzle assembly of the present invention.

Figure 1:
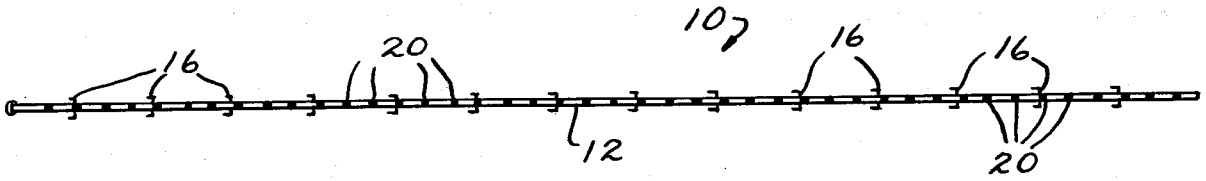
FIG. 1 is a somewhat schematic top plan view of a center pivot agricultural irrigation sprinkler system embodying the principles of the present invention.
Figure 2:
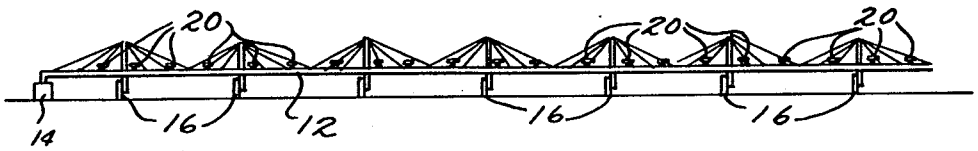
FIG. 2 is an enlarged fragmentary side elevational view of a portion of the system shown in FIG. 1.
Figure 3:
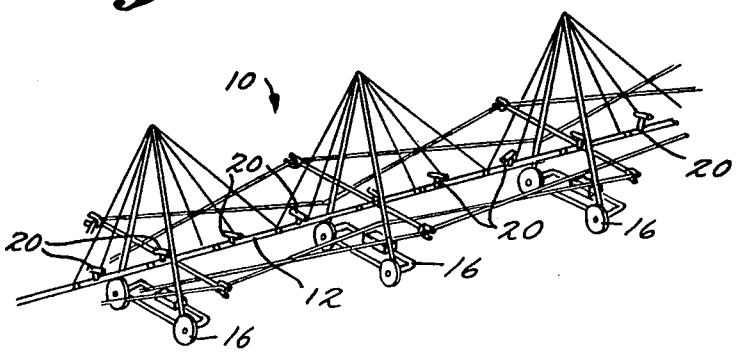
FIG. 3 is an enlarged fragmentary perspective view of a portion of the system shown in FIG. 2.

Referring now more particularly to FIGS. 1–3 of the drawings, there is shown therein a center pivot agricultural irrigation system, generally indicated at 10, which embodies the principles of the present invention. As shown, the center pivot system 10 includes a main pipe line or conduit assembly 12. One end of the conduit assembly 12 is swivelly connected for pivotal movement about an upright axis with a vertically extending supply pipe or conduit 14. The portion of the conduit assembly 12 extending outwardly from the supply pipe 14 is supported above the field surface by a plurality of wheeled towers or ground engaging assemblies 16 operatively connected with the conduit assembly 12 at longitudinally spaced positions therealong.

The construction and operation of the assemblies 12 and 16 as well as the construction of the source pipe and the manner in which the source pipe is fed a supply of water under pressure, as by an engine-pump assembly not shown, is fully disclosed in Zybach U.S. Pat. No. 2,604,359. See also Gordan U.S. Pat. Nos. 2,893,643; Zybach 2,941,727; and Harris 3,484,046, for improvements therein. For purposes of the present invention, it is sufficient merely to note that the conduit assembly 12 is connected in communicating relation with the source of water under pressure flowing from the source pipe 14 and that a portion of the water under pressure flowing in the conduit assembly is utilized as a power source for propelling each of the ground engaging assemblies 16 so that the entire conduit assembly is moved in a plane parallel with the field about the vertical axis of the source pipe at a predetermined rate of speed. A detailed understanding of the manner in which this function is accomplished can be obtained by reference to one or more of the aforesaid patents. It will be understood that the rate of movement of the ground engaging assemblies increases as their position along the conduit assembly from the source pipe increases. It will also be understood that the means for converting the water under pressure into propulsion movement includes a compensating mechanism for varying the speed of propulsion to accommodate variations in the vertical level of the surface of the field to insure that the conduit assembly will be maintained in substantial longitudinal alignment. The construction of the mechanism for accomplishing this compensating propulsion movement is likewise fully disclosed in the above-mentioned patents, all of which are incorporated by reference herein and to which reference may be had if necessary. The pivot move system 10 also includes a series of step-by-step rotary sprinkler heads, generally indicated at 20, mounted in longitudinally spaced relation along the conduit assembly 12. The sprinkler heads 20 communicate with the water under pressure within the conduit assembly and serve to distribute the water onto the field during the operative pivotal movement of the system.

The series of sprinkler heads 20 includes at least a plurality of improved sprinkler heads constructed in accordance with the principles of the present invention.

Figure 5:
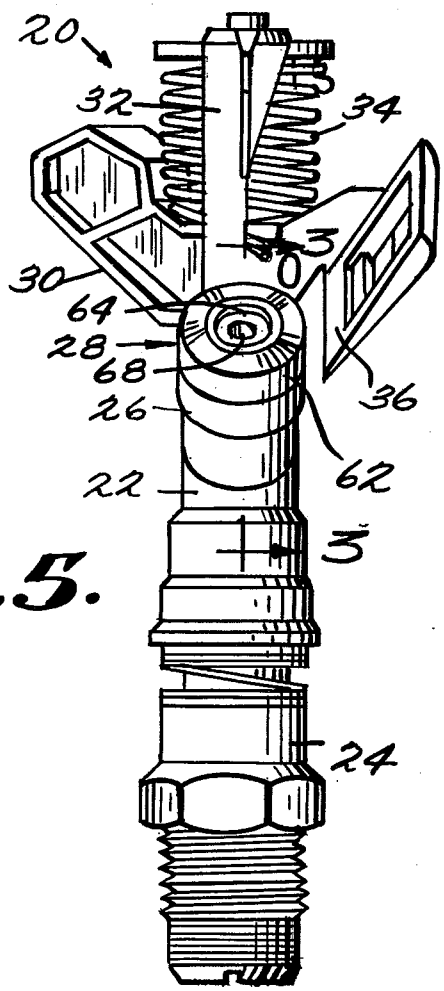
FIG. 5 is a front elevational view of the sprinkler head shown in FIG. 4 illustrating the impulse arm in an intermediate position.
Figure 4:
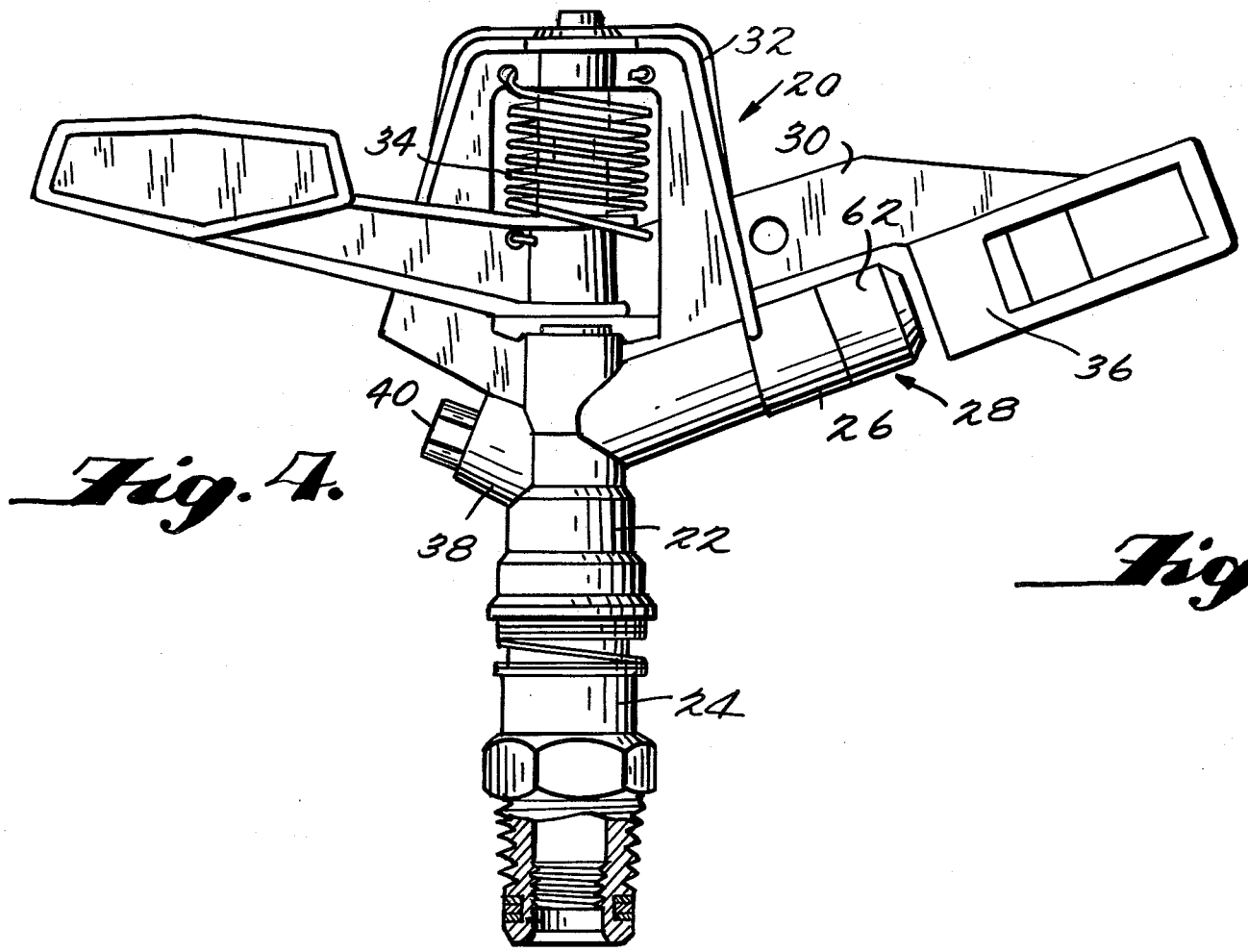
FIG. 4 is a side elevational view with certain parts broken away of a rotary step-by-step impact type sprinkler head embodying the principles of the present invention.

Referring now more particularly to FIGS. 4 and 5 of the drawings, there is shown therein one embodiment of a step-by-step rotary sprinkler head 20, embodying the principles of the present invention. The sprinkler head 20 includes the usual components comprising a hollow sprinkler body 22 having a downwardly opening inlet connected with a bearing assembly 24 of conventional construction. In accordance with conventional practice, the bearing assembly 24 is adapted to be threadedly engaged on the outlet end of a riser pipe or the like and serves as a stationary structure to mount the sprinkler head body 22 for controlled rotational movement about an axis which extends vertically in operation. The rotation is controlled by the usual spring means embodied in the bearing assembly 24. Of course, the bearing assembly also conventionally serves to communicate a source of water under pressure with the inlet of the hollow body 22.

The water under pressure communicated with the inlet of the hollow body 22 flows upwardly and outwardly through an outlet 26 within which a nozzle insert assembly, generally indicated at 28, and embodying the principles of the present invention, is mounted. The sprinkler head 20 also includes an impulse arm 30 which is mounted in the usual fashion above the hollow body 22 for oscillatory movement about an axis which, in the embodiment shown, coincides with the rotational axis of the hollow body. The impulse arm 30 is mounted for oscillatory movement toward and away from a limiting position wherein the arm engages an upwardly extending generally inverted U-shaped mounting structure 32 formed integrally with the hollow body 22. In accordance with conventional procedure, the impulse arm 30 is biased into its limiting position by a coil spring 34 which is connected between the impulse arm and the mounting structure 32. Also in accordance with conventional procedure, the impulse arm 30 has a reactant element 36 formed thereon in a position to be engaged by the stream of water issuing from the nozzle insert assembly 28 when the impulse arm is disposed in its limiting position. The reactant element includes the usual outer reactant surface which serves to effect the movement of the impulse arm in a direction away from its limiting position against the bias of the spring 34 and an inner reactant surface which pulls the reactant arm into the stream as the reactant arm approaches the limiting position under the action of the spring 34. It will be understood that the hollow body 22 may be of the type which provides a separate spreader outlet 38 within which a spreader nozzle may be mounted. However, as shown, the outlet 38 is closed by a plug 40.

Referring now more particularly to FIGS. 6 and 7, it will be noted that the outlet 26 of the hollow body is defined by an annular wall which includes an end surface 42. Formed in the inner periphery of the annular wall 26 adjacent the end surface 42 is a cylindrical surface 44. Preferably, a slight chamfer is provided at the intersection between the end surface 42 and cylindrical surface 44 to eliminate any sharp edge being formed by such intersection. The inner periphery of the annular wall 26 disposed inwardly of the cylindrical surface 44 is formed with helical threads 46 of conventional straight configuration.

The nozzle insert assembly 28 includes a metallic annular body 48 which is preferably formed of brass. The body includes an inner end and an outer end and has a flow passage 50 extending therethrough.

The exterior periphery of the inner end of the annular body 48 is formed with exterior threads 52 which are of straight configuration and adapted to interengage with the threads 46 in a relatively loose fashion. Formed in the exterior periphery of the annular body 48 adjacent the outer end of the threads 52 is an annular groove 54 adapted to receive an O-ring 56. Formed on the exterior periphery of the outer end of the annular body 48 is an annular flange 58 having an inwardly facing end surface 60 providing a stop for engaging the end surface 42 of the outlet 26 to limit the inward movement of the annular body 48.

The flange 58 of the annular body 48 is exteriorly threaded so as to enable the annular body to serve as an adapter for converting the usual interior threads 46 of the outlet 26 into exterior threads for the purpose of threadedly receiving an apertured end cap 62 of brass or the like which, in turn, serves as a rigid housing for an annular flow control and stream defining member 64 of resilient material, such as rubber or the like. It will be understood that outlet 26 may be formed with exterior threads in which case the annular body 58 can be eliminated. Another advantage of the use of the adapter body 58 is that it enables an interiorly finned plastic sleeve 66 to be inserted within the outlet 26 inwardly of the annular body 58. The interiorly finned sleeve 66 serves to direct the water flowing within the hollow sprinkler body 22 outwardly toward the resilient annular member 64 with less turbulence and hence less pressure loss. The interior finned sleeve 66 is of well-known construction and the desirability of utilizing the same is likewise well known, particularly in sprinkler heads of higher capacity.

It will be understood that the resilient annular member 64 has a generally cylindrically shaped orifice 68 extending therethrough, the size of which can be varied to suit the particular desired output capacity of the sprinkler head. An annular member has a generally flat disk-shaped exterior configuration which cooperates with the interior configuration of the housing cap 62. The exact configuration of the annular member 64, the resilient material utilized and method of constructing the same, as well as the exact configuration of the interior surface of the member 62 housing the same, are all preferably in accordance with the commercial practices utilized in connection with the aforesaid Dole flow control assemblies as disclosed in the aforementioned brochure and related patents, all of which are hereby incorporated by reference into the present specification.

As can be seen from FIGS. 6 and 7, the interior configuration of the cap member 62 includes an inner threaded section 70, an outer cylindrical surface 72 for receiving the exterior periphery of the resilient annular member 64, the inner end of which is defined by a small retaining flange 74 and the outer end of which is defined by the apertured end wall of the cap member. The apertured end wall includes an outer radial surface 76, an intermediate frustoconical surface 78 and an inner frustoconical surface 80 which terminates in a chamfered aperture 82. An exemplary set of dimensions for the cylindrical surface 72 is 0.170 inch diameter by 0.180 inch length with the radial surface 76 extending to a diameter of 0.438 inch, the intermediate surface 78 extending at a 45° angle to a diameter of 0.359 inch and the inner surface 80 extending at an angle of 15° to a diameter of 0.323 inch.

In general these dimensions are applicable to sprinkler heads of a size corresponding to a conventional impact sprinkler head having fixed nozzle sizes ranging from 7/64 inch up to 9/32 inch. Resilient annular members 64 with a corresponding range of orifice sizes can be utilized therewith.

It will be understood that when the sprinkler head is inoperable, that is, not communicated with a source of water under pressure, the resilient annular member 64 assumes the position shown in FIG. 6. When the source of water is communicated with the source of water under pressure, the water will flow through the inlet of the hollow sprinkler body 22 and into outlet 26 to communicate with the resilient annular member 64. As soon as the water pressure reaches a predetermined minimum threshold pressure as for example 15 psi, the resilient annular member starts to deform or deflect, first against intermediate surface 78 and then inner surface 80, as shown in FIG. 7, if the source pressure is high enough. This deformation in turn reduces the size of the orifice 68. The amount of deformation of the resilient annular member is proportional to the water source pressure communicating therewith. Likewise the amount of reduction in the orifice size is proportional to the amount of deformation. The proportions involved are such that at a median point within the pressure capacity range of the specific orifice size, the rated output gpm is obtained with a stream of a diameter of intermediate size so that a decrease in pressure within the capacity range will result in an increase in the stream diameter size and decrease in the stream velocity to obtain a substantially equal output gpm whereas an increase in pressure within the capacity range will result in a decrease in the stream diameter size and increase in the stream velocity to obtain a substantially equal output gpm. It will be understood therefore that the term "proportional" contemplates both straight line and curved line relationships in the variables involved.

These proportional relationships insure that the water passing through the orifice 68 of the resilient member 64 is defined as a stream entering the atmosphere by the orifice itself and that the rate of flow of the stream will be substantially constant throughout a wide range of pressure variation above the minimum threshold pressure by varying the cross-sectional size of the stream and velocity of the stream inversely with respect to each other such that a substantially constant amount of water per unit time is always contained in the stream. It is important that the orifice 68 define the stream entering the atmosphere although various deflections of the stream once it is defined by the orifice and enters the atmosphere may be utilized. Indeed, the reactant member 36 constitutes such a deflection which constitutes a significant factor in the distribution pattern of the sprinkler head 20.

It thus will be seen that the objects of this invention have been fully and effectively accomplished. It will be realized, however, that the foregoing specific embodiment has been shown and described only for the purpose of illustrating the principles of this invention and is subject to extensive change without departure from such principles. Therefore, this invention includes all modifications encompassed within the spirit and scope of the following claims.

What is claimed is:

1. An agricultural irrigation sprinkler system for distributing a source of water under pressure above a predetermined minimum pressure onto a horizontal surface of an agricultural field which may vary in vertical height comprising a multiplicity of sprinkler heads adapted to operate in different positions within said field, conduit means operatively connected with said sprinkler heads for communicating a source of water under pressure with said sprinkler heads, the improvement in combination therewith which comprises at least one of said sprinkler heads comprising:

a water sprinkler body having an inlet adapted to be communicated with the source of water under pressure and an outlet in flow communicating relation with said inlet, means fixedly connected with said conduit means for the water under pressure for mounting said sprinkler body for movement with respect to said conduit means through repetitive cycles of movement, an annular member of resilient material having interior surface means, spaced exterior surface means, and a discharge orifice defining opening therebetween, means for mounting said annular member within said outlet of said water sprinkler body such that water flowing through said inlet in communication with the interior surface means of said resilient annular member will deform said resilient annular member an amount proportional to the amount such water pressure is in excess of said predetermined minimum pressure and by such deformation reduce the size of said opening an amount proportional to said deformation so that the water flowing through said opening out of fluid pressure communicating relation with the exterior surface means of said resilient annular member is defined as a stream entering the atmosphere with a cross-sectional size and velocity which vary inversely with respect to each other such that a substantially constant amount of water per unit time is contained in the aforesaid stream entering the atmosphere throughout the aforesaid range of pressure variation in the source, means carried by said sprinkler body operable in response to the flow of water under pressure from said conduit means through said resilient annular member opening for effecting a repetitive cyclical movement of said sprinkler body so as to cause the stream issuing from said resilient annular member opening to be distributed onto an area greater than the area onto which the stream is distributed at any one time, said mounting means including a rigid annular wall fixed with respect to said sprinkler body and disposed in spaced relation outwardly in the direction of flow to the portion of said resilient annular member defining said opening when there is no water under pressure in communication with said resilient annular member, said rigid annular wall having interior annular surface means positioned to be engaged by outward deformation of said resilient annular member when the latter is communicated with water under pressure as aforesaid.

2. An agricultural irrigation sprinkler system as defined in claim 1 wherein said conduit means comprises an elongated articulate main line pivotally connected at one end to a vertically extending supply pipe, and a plurality of wheeled power driven towers supporting said main line in vertically spaced relation above the surface of the field for pivotal movement about said supply pipe.

3. An agricultural irrigation sprinkler system as defined in claim 2 wherein substantially all of said multiplicity of sprinkler heads are constructed as said one sprinkler head.

4. An agricultural sprinkler irrigation system for distributing a source of water under pressure above a predetermined minimum pressure onto a horizontal surface of an agricultural field which may vary in vertical height comprising wheeled vehicle means, means carried by said wheeled vehicle means operable by the communication of water under pressure therewith for effecting a movement of said wheeled vehicle means over the horizontal surface of the field, a sprinkler head carried by said wheeled vehicle means, and conduit means adapted to be connected with the source of water under pressure for communicating the source of water under pressure with said moving means and said sprinkler head so as to operate said sprinkler head during the movement of said wheeled vehicle means over the horizontal surface of the field, the improvement in combination therewith which comprises said sprinkler head comprising:

a water sprinkler body having an inlet adapted to be communicated with the source of water under pressure and an outlet in flow communicating relation with said inlet, means fixedly connected with said conduit means for the water under pressure for mounting said sprinkler body for movement with respect to said conduit means through repetitive cycles of movement, an annular member of resilient material having interior surface means, spaced exterior surface means, and a discharge orifice defining opening therebetween, means for mounting said annular member within said outlet of said water sprinkler body such that water flowing through said inlet in communication with the interior surface means of said resilient annular member will deform said resilient annular member an amount proportional to the amount such water pressure is in excess of said predetermined minimum pressure and by such deformation reduce the size of said opening an amount proportional to said deformation so that the water flowing through said opening out of fluid pressure communicating relation with the exterior surface means of said resilient annular member is defined as a stream entering the atmosphere with a cross-sectional size and velocity which vary inversely with respect to each other such that a substantially constant amount of water per unit time is contained in the aforesaid stream entering the atmosphere throughout the aforesaid range of pressure variation in the source, means carried by said sprinkler body operable in response to the flow of water under pressure from said conduit means through said resilient annular member opening for effecting a repetitive cyclical movement of said sprinkler body so as to cause the stream issuing from said resilient annular member opening to be distributed onto an area greater than the area onto which the stream is distributed at any one time, said mounting means including a rigid annular wall fixed with respect to said sprinkler body and disposed in spaced relation outwardly in the direction of flow to the portion of said resilient annular member defining said opening when there is no water under pressure in communication with said resilient annular member, said rigid annular wall having interior annular surface means positioned to be engaged by outward deformation of said resilient annular member when the latter is communicated with water under pressure as aforesaid.

5. A water sprinkling device for directing a source of water under pressure, which may vary within a wide range above a predetermined minimum pressure, at a substantially constant rate into the atmosphere for distribution onto an area to be sprinkled comprising:

a water sprinkler body having an inlet adapted to be communicated with the source of water under pressure and an outlet in flow communicating relation with said inlet, means fixedly connectable with a source pipe for the water under pressure for mounting said sprinkler body for movement with respect to such source pipe through repetitive cycles of movement, an annular member of resilient material having interior surface means, spaced exterior surface means, and a discharge orifice defining opening therebetween, means for mounting said annular member within said outlet of said water sprinkler body such that water flowing through said inlet in communication with the interior surface means of said resilient annular member will deform said resilient annular member an amount proportional to the amount such water pressure is in excess of said predetermined minimum pressure and by such deformation reduce the size of said opening an amount proportional to said deformation so that the water flowing through said opening out of fluid pressure communicating relation with the exterior surface means of said resilient annular member is defined as a stream entering the atmosphere with a cross-sectional size and velocity which vary inversely with respect to each other such that a substantially constant amount of water per unit time is contained in the aforesaid stream entering the atmosphere throughout the aforesaid range of pressure variation in the source, means carried by said sprinkler body operable in response to the flow of water under pressure from the source pipe through said resilient annular member opening for effecting a repetitive cyclical movement of said sprinkler body so as to cause the stream issuing from said resilient annular member opening to be distributed onto an area greater than the area onto which the stream is distributed at any one time, said mounting means including a rigid annular wall fixed with respect to said sprinkler body and disposed in spaced relation outwardly in the direction of flow to the portion of said resilient annular member defining said opening when there is no water under pressure in communication with said resilient annular member, said rigid annular wall having interior annular surface means positioned to be engaged by outward deformation of said resilient annular member when the latter is communicated with water under pressure as aforesaid.

6. A water sprinkling device as defined in claim 5 wherein said mounting means includes a rigid annular member having said annular wall on one end thereof, an interiorly threaded section on the opposite end thereof and intermediate section between said interiorly threaded section and said annular wall, the interior of said intermediate section being configured to receive said resilient annular member.

7. A water sprinkling device as defined in claim 6 wherein said rigid annular wall defines an aperture of a size greater than the size of the opening in said resilient annular member.

8. A water sprinkling device as defined in claim 7 wherein said intermediate section includes a cylindrical surface for receiving the outer periphery of said resilient annular member, said rigid annular wall including an annular planar surface extending radially inwardly from said cylindrical surface, said annular surface means of said rigid annular wall including an intermediate frustoconical surface extending from said radial surface at an angle of approximately 45° and a second frustoconical surface extending from said intermediate frustoconical surface at an angle of approximately 15° and terminating to form the aperture of said annular wall.

9. A water sprinkling device as defined in claim 8 wherein said resilient annular member is disk shaped in exterior configuration with said opening extending concentrically through the axis thereof.

10. A water sprinkling device as defined in claim 9 wherein said mounting means further includes a rigid sleeve member exteriorly threadedly engaged within cooperating interior threads in the sprinkler body outlet, said sleeve including an annular flange extending radially outwardly therefrom beyond the end of said sprinkler body outlet, the outer periphery of said annular flange being exteriorly threaded to receive the interiorly threaded section of said rigid annular member.

11. A water sprinkling device as defined in claim 10 wherein the sprinkler body outlet includes an interior cylindrical surface at the outer end thereof having an O-ring seal engaging the same, said rigid sleeve member including a cylindrical exterior surface adjacent said flange engaging said O-ring seal.

12. A water sprinkling device as defined in claim 6 wherein said mounting means further includes a rigid sleeve member exteriorly threadedly engaged within cooperating interior threads in the sprinkler body outlet, said sleeve including an annular flange extending radially outwardly therefrom beyond the end of said sprinkler body outlet, the outer periphery of said annular flange being exteriorly threaded to receive the interiorly threaded section of said rigid annular member.

13. A water sprinkling device as defined in claim 12 wherein the sprinkler body outlet includes an interior cylindrical surface at the outer end thereof having an O-ring seal engaging the same, said rigid sleeve member including a cylindrical exterior surface adjacent said flange engaging said O-ring seal.

* * * * *